US005343419A

United States Patent [19]

Shu et al.

[11] Patent Number: 5,343,419

[45] Date of Patent: Aug. 30, 1994

[54] ANALOG CALCULATION CIRCUIT USING TIMERS

[75] Inventors: Guoliang Shu; Weikang Yang; Wiwat Wongwarawipat; Sunao Takatori; Makoto Yamamoto, all of Tokyo, Japan

[73] Assignee: Yozan, Inc., Tokyo, Japan

[21] Appl. No.: 964,157

[22] Filed: Oct. 21, 1992

[30] Foreign Application Priority Data

| | | | |
|---|---|---|---|
| Sep. 25, 1992 | [JP] | Japan | 4-280792 |
| Oct. 6, 1992 | [JP] | Japan | 4-292137 |
| Oct. 8, 1992 | [JP] | Japan | 4-298110 |
| Oct. 9, 1992 | [JP] | Japan | 4-298044 |
| Oct. 16, 1992 | [JP] | Japan | 4-304944 |

[51] Int. Cl.[5] ..... G06G 7/00

[52] U.S. Cl. ..... 364/807

[58] Field of Search ..... 364/807, 808, 841, 844

[56] References Cited

U.S. PATENT DOCUMENTS

| | | | |
|---|---|---|---|
| 3,676,661 | 7/1972 | Sprowl | 364/844 |
| 3,831,014 | 8/1974 | Haid | 364/844 |

*Primary Examiner*—Long T. Nguyen

*Attorney, Agent, or Firm*—Cushman, Darby & Cushman

[57] ABSTRACT

An analog calculation circuit has a circuit input for receiving a first input voltage, a circuit output, a first timer, and a second timer. The first timer has a first capacitive coupler, a first RC circuit, and a first threshold circuit for outputting a first timer output voltage. The first threshold circuit has a first threshold input terminal. The first capacitive coupler has a first capacitive coupler input connected to the circuit input, a second capacitive coupler input, and a first capacitive coupler output connected to the first threshold input terminal. The first RC circuit has a first resistance, a first capacitance, a first RC input for receiving a second input voltage, and a first RC output connected to the second capacitive coupler input. The second timer has a second RC circuit, a second threshold circuit for outputting a second timer output voltage to the second RC circuit, and for receiving the first timer output voltage. The second RC circuit has a second resistance, a second capacitance, a second RC input for receiving a third input voltage, and a second RC output connected to the circuit output. A third timer, similar in design to the first timer may also be used in the calculation circuit.

26 Claims, 13 Drawing Sheets

Th2
invertors
Cp2
R2
CC2
Th1
invertors
Cp1
R1
CC1
Y
X
START
RP
Th6
nMOS
pMOS
Vt6
CC6
R6
T6

ANALOG CALCULATION CIRCUIT USING TIMERS

BACKGROUND OF THE INVENTION

1. Field of the Invention

The present invention relates to a precise analog calculation circuit which utilizes timers.

2. Description of the Art

A digital calculation circuit is normally highly accurate but is usually rather large in scale. A typical analog calculation circuit, on the other hand, performs rather imprecise calculations.

In a digital computer, a memory is used as a table for defining the relationship between an input and an output according to a mathematical calculation. This is merely one way to minimize the scale of the logical circuits required in order to perform a calculation. However, the memory itself is comprised of a large number of transistor gates and therefore, an immense amount of electrical power is wasted.

SUMMARY OF THE INVENTION

An object of the present invention is to provide a calculation circuit which is small in scale but performs highly accurate calculations.

A calculation circuit, according to the present invention, includes analog timers and produces an output voltage which is based on an exponential time factor.

The present invention performs precise calculations because the exponential time factor, and can be produced by the use of conventional analog circuit technology. The circuit's physical scale is therefor much smaller than a conventional digital calculation circuit which performs a similar calculation.

PREFERRED EMBODIMENTS OF THE PRESENT INVENTION

An embodiment of a multiplication circuit according to the present invention is described with reference to the attached drawings.

Figure 1:
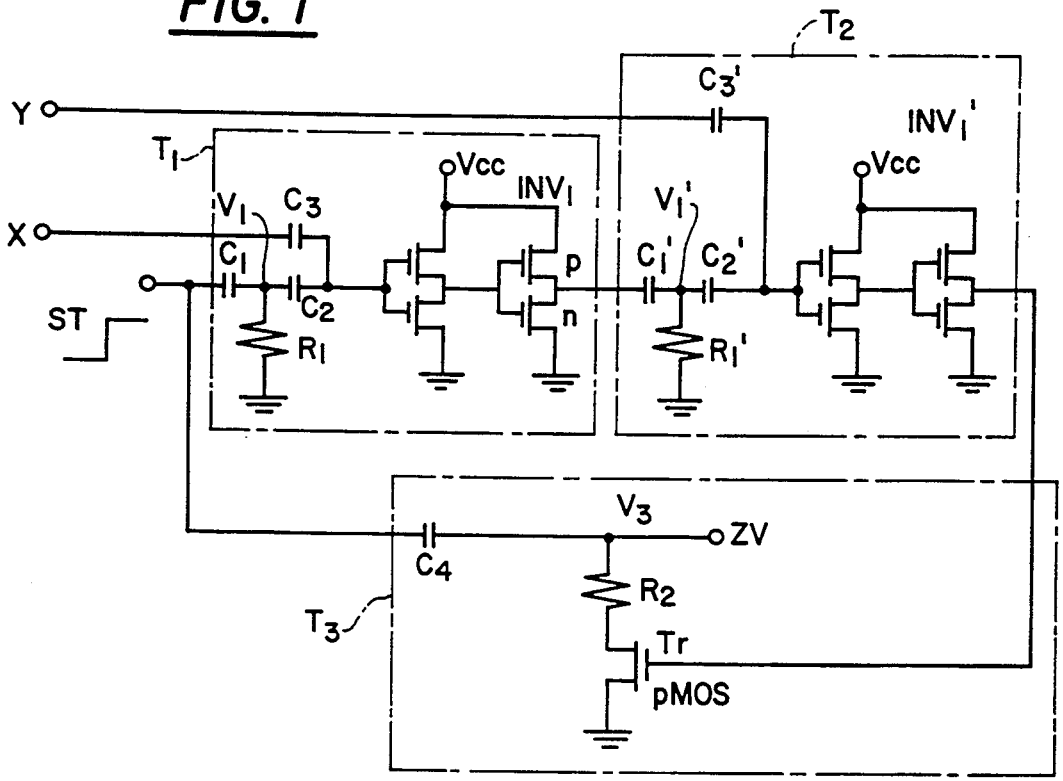
FIG. 1 depicts a multiplication circuit according to one embodiment of the present invention.

In FIG. 1, the multiplication circuit comprises a first timer $T_1$, a second timer $T_2$ and a third timer $T_3$. Input voltage "X" and "Y" are input to timers $T_1$ and $T_2$, respectively.

Timer $T_1$ comprises capacitances $C_1$ and $C_2$ connected in series: the connection between capacitances $C_1$ and $C_2$ is grounded through a high resistance $R_1$. A step voltage, which acts as a starting trigger (ST), is input to the lead of capacitor $C_1$ which is not connected to capacitance $C_2$. The input voltage "X" is connected through capacitance $C_3$ to capacitance $C_2$. Inverter ($INV_1$) is connected between capacitances $C_2$ and $C_3$. $INV_1$ outputs a maximum value when its input voltage is smaller than a threshold voltage, and it outputs 0V when its input voltage is above the threshold voltage. If starting trigger ST is input while the input voltage "X" is also input, the potential difference across capacitance $C_1$ increases gradually, and the voltage between capacitances $C_1$ and $C_2$ decreases gradually. Consequently, the input voltage to $INV_1$ decreases. The output voltage of $INV_1$ becomes 0V when $V_1$ equals "X".

Figure 2:
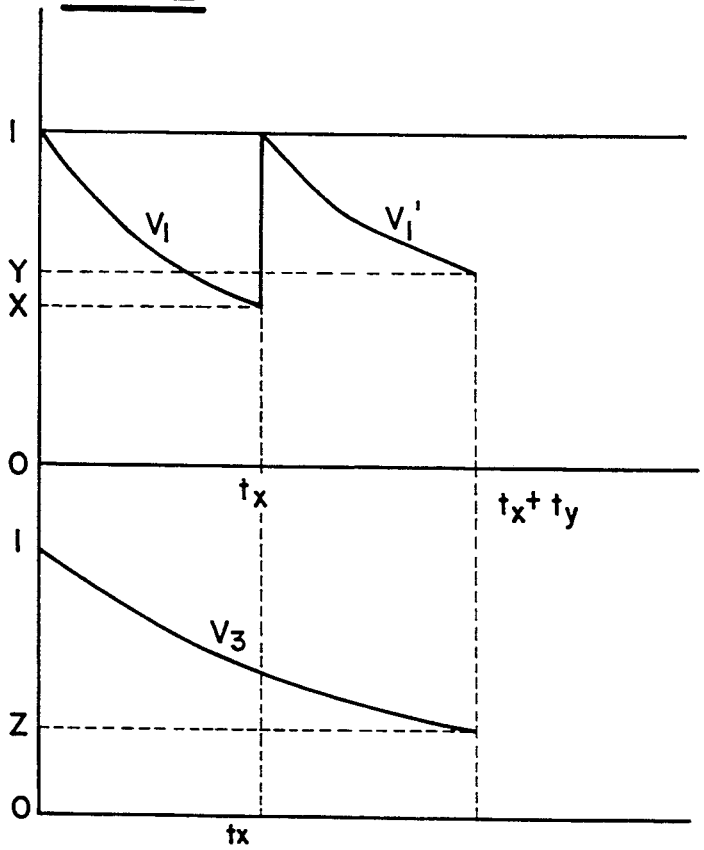
FIG. 2 is a diagram illustrating the characteristics of timers shown in FIG. 1.

The change in voltage $V_1$, between capacitances $C_1$ and $C_2$, is graphed in FIG. 2 and can be expressed by the formula:

$$V_1 = V_{st}e^{-\left(\frac{t}{R1C1}\right)}$$

wherein:

$t_1$ is time; and $V_{st}$ is the Maximal Voltage of the Starting Trigger ST

Timer $T_2$ is constructed in a manner similar to timer $T_1$. The construction elements are expressed using "'". The output of $INV_1$ is used as an input to capacitance $C_1'$. When the output of $INV_1$ is 0V, the voltage between capacitance $C_1'$ and capacitance $C_2'$ begins to decrease and the output voltage of $INV_1'$ becomes 0V when $V_1'$ equals "Y".

The output of $INV_1'$ and the starting trigger ST are input to the timer $T_3$. The total charging time or the total acting time of timers $T_1$ and $T_2$ is equal to the total charging time of timer $T_3$. Timer $T_3$ comprises a pMOS ("Tr", hereafter) in which the output of $INV_1'$ is used as the input to the gate of Tr. The starting trigger ST is input to the drain of Tr through capacitance $C_4$ and resistance $R_2$. The source of Tr is grounded, Tr becomes conductive when the output voltage of $INV_1'$ is above a threshold voltage. When the gate voltage of Tr is 0V, a type of breaking occurs on Tr and the electrical charge of $C_4$ is maintained. In other words, timer $T_3$ is charged by starting trigger ST in period of time which is equal to the sum of the charging times for Timers $T_1$ and $T_2$.

The charging characteristic of timer $T_3$can be expressed by the following equation:

$$V_2 = V_{st}e^{-(\frac{t3}{R2C4})}$$

wherein:

$t_3$ is time; and $V_{st}$ is the Maximal Voltage of the Starting Trigger when $R_1=R_1'=R_2$ and $C_1=C_1'=C_4$, the following formulas can be derived.

$$\left(\frac{X}{V_{st}}\right)\left(\frac{Y}{V_{st}}\right)=\left(\frac{Z}{V_{st}}\right)$$

$$e^{-(\frac{t1}{R1C1})}e^{-(\frac{t2}{R'1C1})}=e^{-(\frac{t3}{R2C4})}$$

The output voltage "Z" of timer $T_3$ (i.e. the voltage between capacitance $C_4$ and $R_2$) is equal to the input voltage "X" multiplied by the input voltage "Y".

An RC circuit is very simple in structure as compared to digital multiplication circuits. Moreover, the voltage obtained according to the charging characteristic of an RC circuit is more precise than can be obtained by the use of general analog multiplication circuits.

Figure 3:
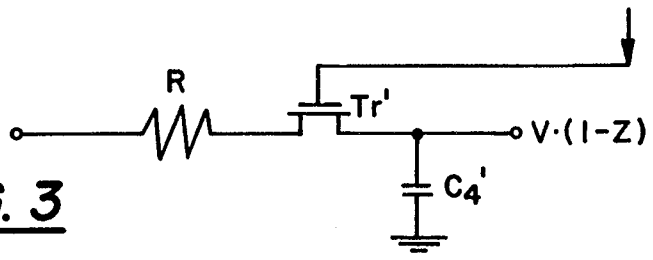
FIG. 3 shows a variation of the third timer of FIG. 1.

In order to obtain the compliment output of "Z" (i.e. the output "1-Z"), the source of Tr' is grounded through $C_4'$, starting trigger ST is input to the drain of Tr' through $R_2'$ and the voltage measured at the source of Tr' is the output voltage "1-Z" as shown in FIG. 3

Figure 4:
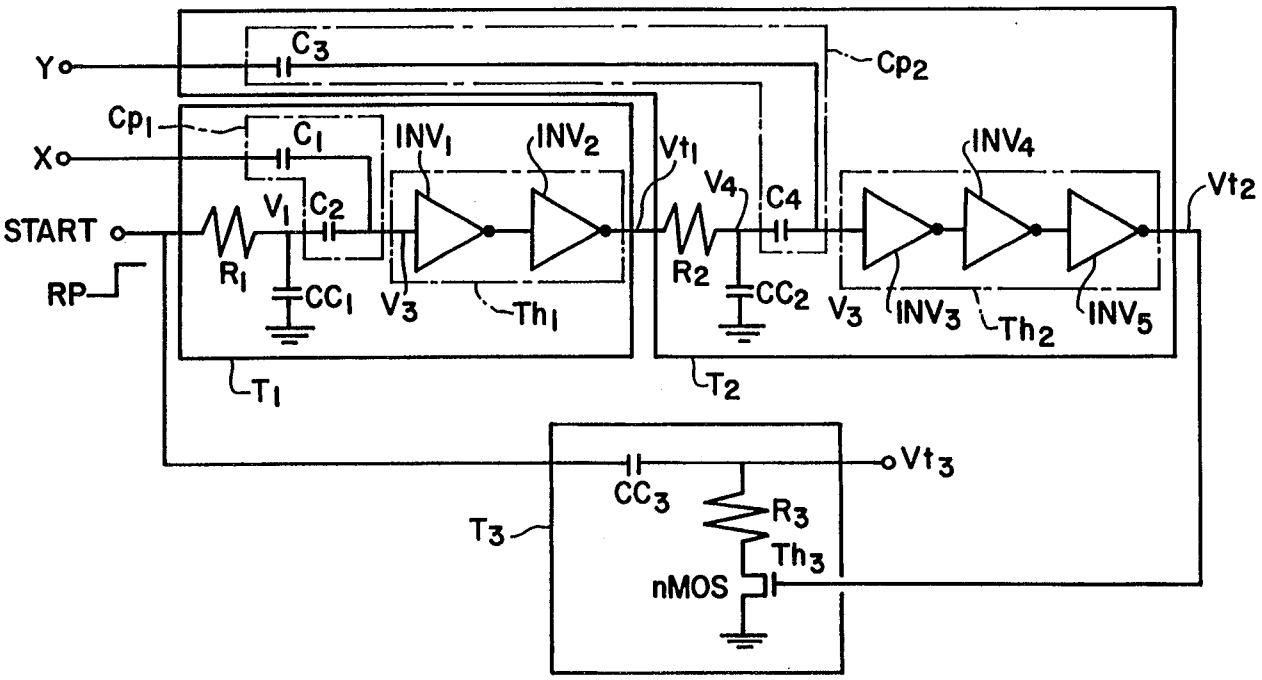
FIG. 4 depicts a multiplication circuit according to another embodiment of the present invention.

In FIG. 4, a multiplication circuit comprises timers $T_1$, $T_2$ and $T_3$. Input voltage "X" is input to timer $T_1$ and input voltage "Y" is input to timer $T_2$.

Timer $T_1$ comprises threshold element $Th_1$ which generates an output voltage when its input voltage is above a given threshold. "$Cp_1$" which performs capacitive coupling of two inputs is connected to the input of $Th_1$. If the voltage impressed upon capacitances $C_1$ and $C_2$ is $V_1$ and $V_2$ respectively, then the input voltage $V_3$ for $Th_1$ can be expressed by the following equation:

$$V_3 = \frac{C_1V_1 + C_2V_2}{C_1 + C_2} \quad (1)$$

$Th_1$ comprises a pair of inverters $INV_1$ and $INV_2$ connected in series. When $V_3$ exceeds a threshold voltage, the output of $INV_1$ is 0V, and the output of $INV_2$ becomes high (i.e. the maximum voltage $V_m$).

The first input voltage "X" is connected to capacitance $C_1$, and a standard voltage pulse RP is connected to capacitance $C_2$ through resistance $R_1$. Capacitance $C_2$ is grounded through capacitance "$CC_1$". When voltage pulse RP is high $CC_1$ becomes charged and $V_2$ rises up to the same voltage as voltage pulse RP.

When the voltage pulse RP rises up to a predetermined level while the input voltage "X" is input to capacitance $C_1$, capacitance $CC_1$ is charged by a predetermined time constant which is determined by the value of $CC_1 \times R_1$. The input voltage $V_3$ can be expressed by the following formula:

$$V_3 = \frac{C_1X + C_2RP[1 - e^{-(\frac{t}{R1CC1})}]}{C_1 + C_2} \quad (2)$$

According to the formula in (2), the input voltage $V_3$ rises as "t" increases. When $V_3$ exceeds the threshold voltage, the output voltage $Vt_1$ of $Th_1$ becomes its maximum voltage "$V_m$".

Figure 7:
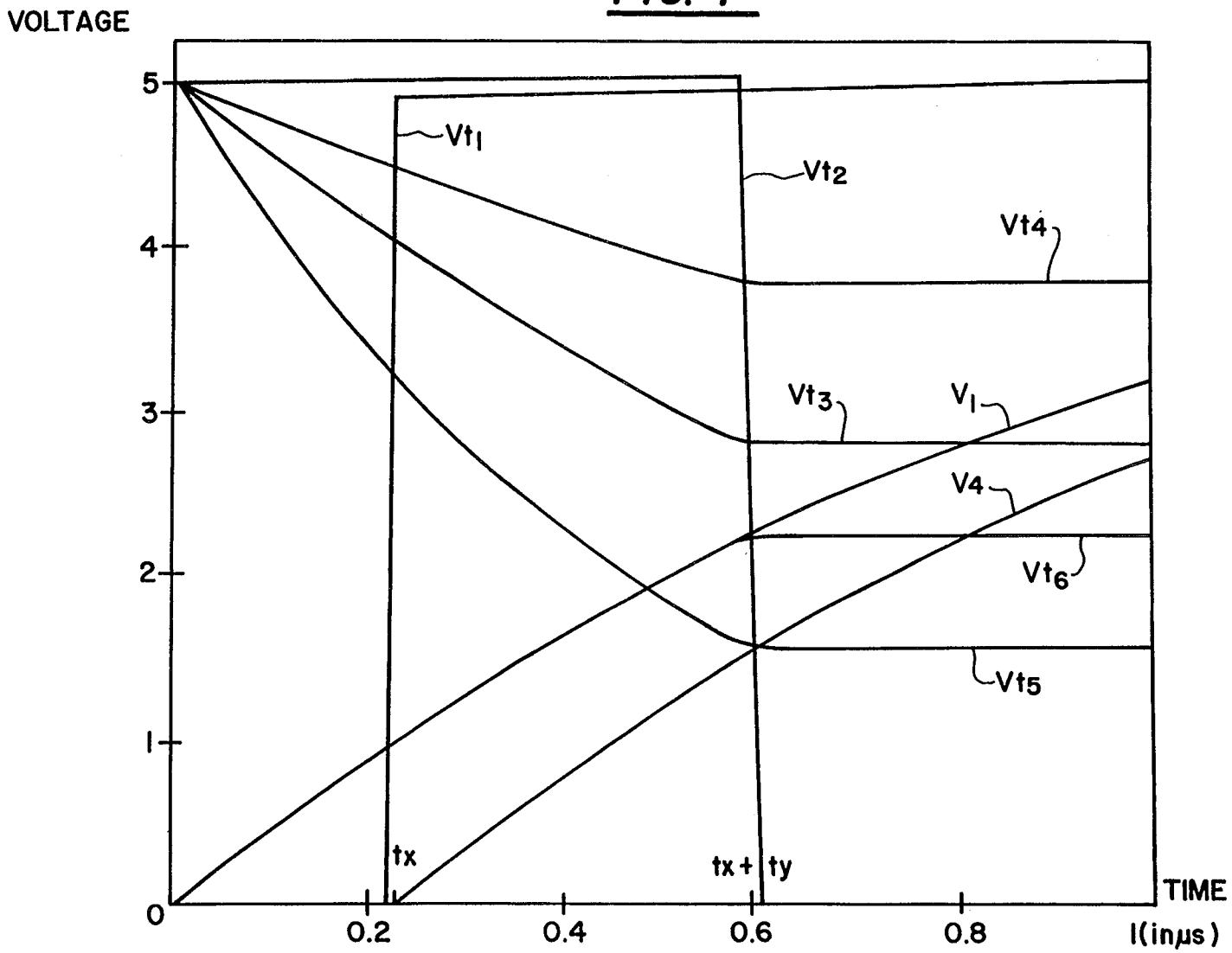
FIG. 7 is a diagram illustrating the characteristics of the embodiments shown in FIG. 4–6.

The time it takes $Vt_1$ to obtain the maximal voltage $V_m$ when $V_1$ is 0V is the time period "tx". FIG. 7 shows the change of $V_1$ and $Vt_1$.

Timer $T_2$ comprises threshold element $Th_2$, capacitive coupling element $Cp_2$, charging capacitance $CC_2$ and resistance $R_2$. The construction of $T_2$ is similar to that of $T_1$. Therefore, each element of $T_2$ corresponds to an element of $T_1$: that is, $Th_2$, $Cp_2$, $CC_2$ and $R_2$ of $T_2$ corresponds to $Th_1$, $Cp_1$, $CC_1$ and $R_1$ of $T_1$. The output of $T_1$ is the input to $R_2$. When $Th_1$ is at a maximal voltage $V_m$, capacitance $CC_2$ is charged and the input voltage $V_4$ to $Cp_2$ rises. If each capacitance of $Cp_2$ is labeled $C_3$ and $C_4$, the second input voltage to $C_3$ labeled Y, and the input to $C_4$ labeled $V_4$, the output voltage $V_5$ of $Cp_2$ can be expressed by the following formulas:

$$V_5 = \frac{C_3Y + C_4V_4}{C_3 + C_4} \quad (3)$$

$$V_5 = \frac{C_3Y + C_4V_m[1 - e^{-(\frac{t}{R2CC2})}]}{C_3 + C_4} \quad (4)$$

When $V_5$ exceeds the threshold voltage of $Th_2$, $Th_2$ generates a maximum output voltage $V_m$. $Th_2$ comprises three inverters $INV_3$, $INV_4$ and $INV_5$ connected in series. The change in voltage at $V_4$ and $Vt_2$ is shown in FIG. 7. The period of time it takes $Vt_2$ to become 0V when $Vt_1$ becomes $V_m$ is labeled "ty". Therefore, the overall time it takes $Vt_2$ to reach 0V is tx+ty.

$T_3$ comprises charging capacitance $CC_3$. Voltage pulse RP is input to one terminal of capacitance $CC_3$ and the other lead is the output terminal $Vt_3$. $Vt_3$ is grounded through resistance $R_3$ and an nMOS ("$Th_3$", hereafter) $Vt_2$ is input to the gate of $Th_3$. $CC_3$ begins charging from the rise of voltage pulse RP and continues charging while $Vt_2$ is at the maximum voltage $V_m$. When $Vt_2$ becomes 0V at time tx+ty, a type of breaking occurs on $Th_3$ and the charging $CC_3$ is completed. Here, $Vt_3$ can be expressed by the following formulas:

$$Vt_3 = RPe^{-(\frac{t}{R3CC3})} \quad (5)$$

$$Vt_3 = RPe^{-(\frac{tx+ty}{R3CC3})} \quad (6)$$

The formula in (2) can be transformed into the formula in (7) using tx and $Vt_1$.

$$e^{-(\frac{tx}{R1CC1})} = \left(\frac{C_1}{C_2RP}\right)X - \left(\frac{C_1 + C_2}{C_2RP}\right)Vt_1 \quad (7)$$

In the same way, the formula in (4) can be transformed into the formula in (8).

$$e^{-\left(\frac{tx}{R_2CC_2}\right)} = \left(\frac{C_3}{C_4V_m}\right)Y - \left(\frac{C_3 + C_4}{C_4V_m}\right)Vt_2 \quad (8)$$

When $R_1=R_2=R_3$, $CC_1=CC_2=CC_3$, $RP=V_m$, and $Vt_1=Vt_2=RP/2$, $Vt_3$ can be expressed by the following formula.

$$Vt_3 = \left(\frac{C_1}{C_2RP}\right)\left(\frac{C_3}{C_4V_m}\right)XY \propto XY \quad (9)$$

Thus, the multiplication X and Y can be obtained by the formula in (9).

The calculation performed by the method just described is very precise. As is clear from FIG. 4, the circuit remains very simple structure.

Figure 5:
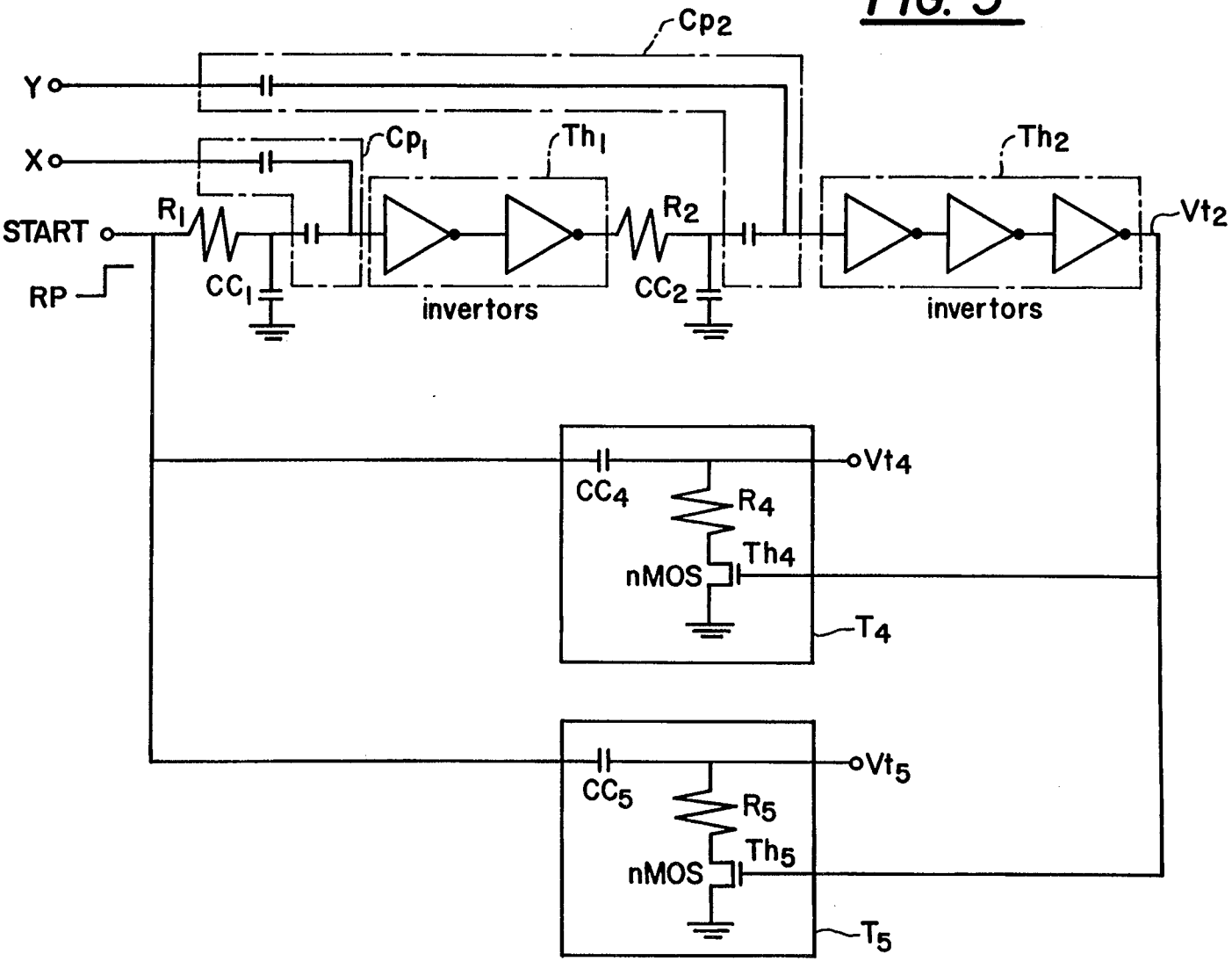
FIG. 5 shows another embodiment of a calculation circuit according to the present invention.

FIG. 5 shows a circuit of another embodiment of the present invention, in which timers $T_4$ and $T_5$ are used instead of timer $T_3$ in FIG. 4.

Timer $T_4$ comprises nMOS $Th_4$, charging capacitance $CC_4$ and resistance $R_4$ in the same way as was used in timer $T_3$.

$$R_4CC_4 = \frac{R_1CC_1}{2} = \frac{R_2CC_2}{2} \quad (10)$$

A predetermined value can be obtained by satisfying the relationship from the formula in (10). The output voltage $Vt_4$ can be expressed by the formula in (11).

$$Vt_4 = \sqrt{\left(\frac{CC_1}{C_2RP}\right)\left(\frac{C_3}{C_4RP}\right)XY} \propto \sqrt{XY} \quad (11)$$

Thus, the calculation in (11) is substantially the same as $(XY)^{\frac{1}{2}}$ The calculation can be changed by changing the time constant.

Timer $T_5$ has the same structure as timer $T_4$, wherein only the time constant is changed. In this case the following formula is used:

$$R_5CC_5=2R_1CC_1=2R_2CC_2 \quad (12)$$

In this case, $Vt_5$ can then be expressed by the formula in (13) .

$$Vt_5 = \left[\left(\frac{C_1}{C_2RP}\right)\left(\frac{C_3}{C_4RP}\right)XY\right]^2 \propto (XY)^2 \quad (13)$$

Thus by satisfying the formula in (13), the square of the inputs is obtained as an output.

Figure 6:
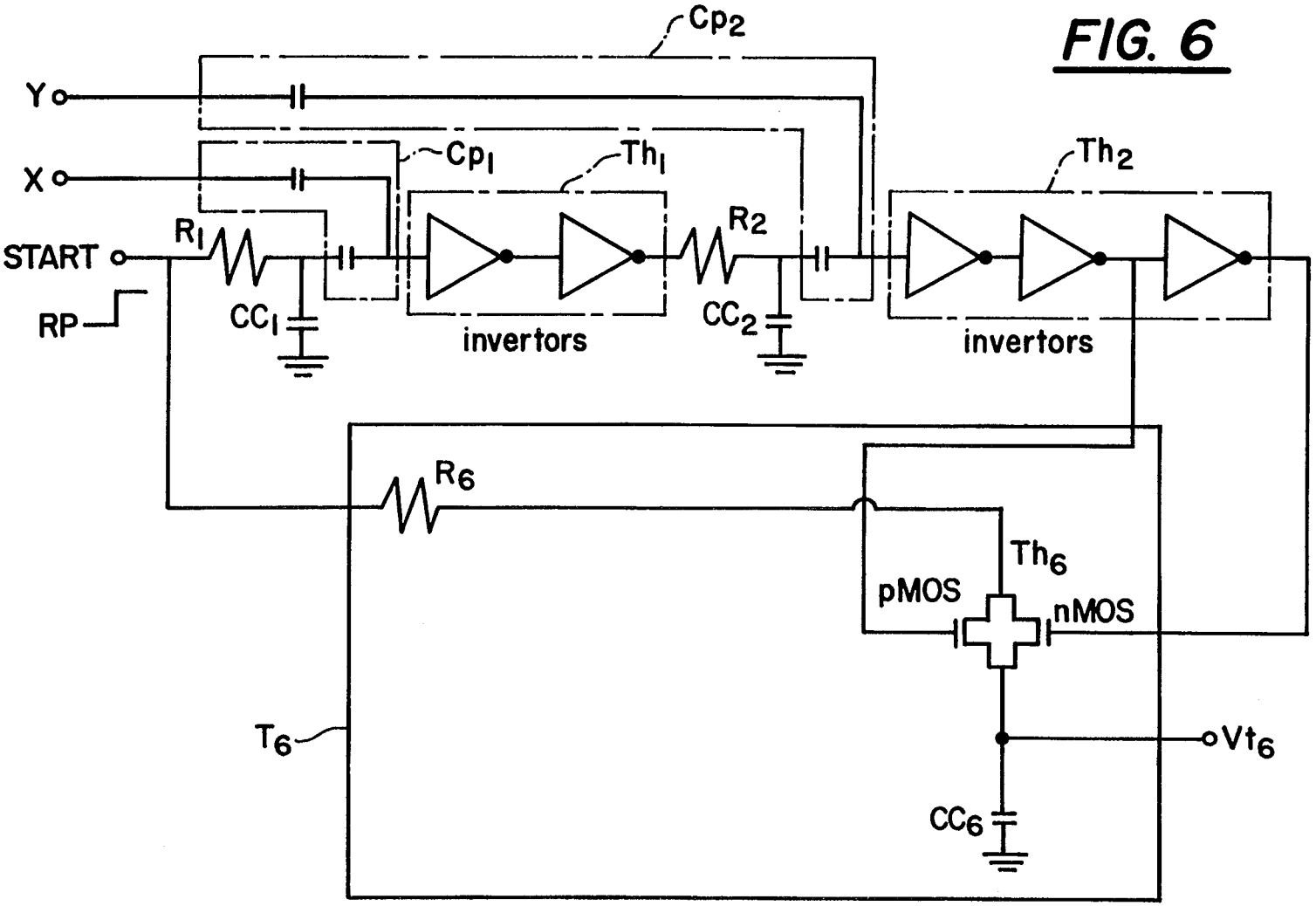
FIG. 6 shows another embodiment of a calculation circuit according to the present invention.

In FIG. 6, timer $T_6$ is used instead of timer $T_3$ and timer $T_6$ comprises resistance $R_6$, CMOS $Th_6$ and capacitance $CC_6$ in series. Furthermore, RP is connected to $R_6$ and $CC_6$ is grounded. The output terminal of timer $T_6$ is between $Th_6$ and $CC_6$. The output $Vt_6$ of timer $T_6$ is described by the following formula:

$$Vt_6 = RP[1 - e^{-\left(\frac{t}{R_6CC_6}\right)}] \quad (14)$$

If in formula (14), $R_6=R_1=R_2$and $CC_6=CC_1=CC_2$, $Vt_6$ can be expressed by the following formula:

$$Vt_6 = RP\left[1 - \left(\frac{C_1}{C_2RP}\right)\left(\frac{C_3}{C_4V_m}\right)XY\right] \quad (15)$$

Thus, by this embodiment, the calculation of the complement of the product of inputs is substantially executed.

The characteristic of the voltage at $Vt_4$–$Vt_6$ is shown in FIG. 7.

Figure 8:
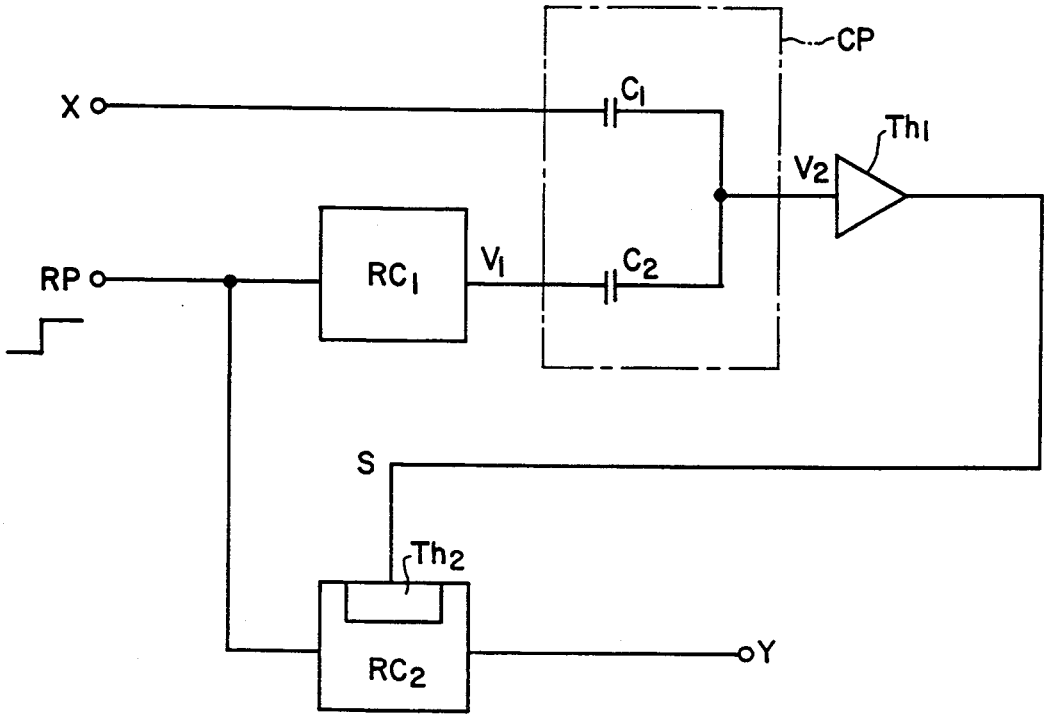
FIG. 8 depicts an embodiment of an exponential calculation circuit according to the present invention.

In FIG. 8, the computation circuit comprises a first and second RC circuit to which a common standard voltage pulse RP is input. The capacitance of $RC_1$ and $RC_2$ is charged by RP in accordance with the time constant of the circuit.

The output voltage $V_1$ of $RC_1$ is the input to one end of capacitance coupler CP and input voltage X is input to the another end of capacitance coupler CP. Selecting each capacitance value of capacitance coupler CP as capacitances $C_1$ and $C_2$, the output voltage $V_2$ of capacitance coupler CP can be expressed by the formula:

$$V_2 = \frac{C_1X + C_2V_1}{C_1 + C_2} \quad (16)$$

In formula (16), X and $V_1$ are linearly coupled. If capacitance $C_1$ is equal to capacitance $C_2$, formula (16) can be expressed as:

$$V_2 = \frac{X + V_1}{2} \quad (17)$$

The output voltage $V_2$ of capacitance coupler CP is input to threshold element $Th_1$ which outputs an output voltage "S" when $V_2$ reaches a predetermined voltage $V_{th}$.

Figure 9:
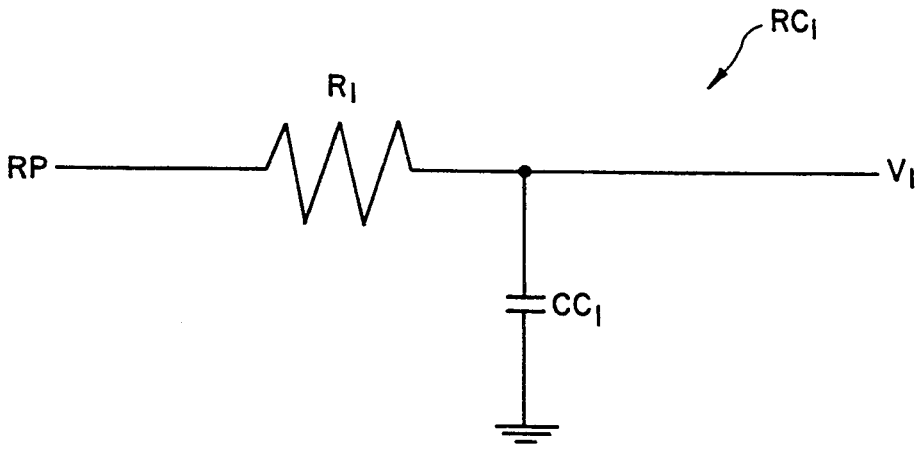
FIG. 9 shows the first RC circuit depicted in FIG.8.
Figure 10:
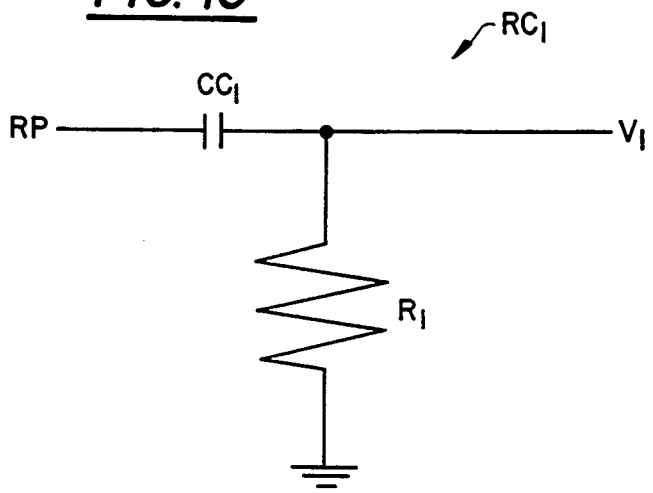
FIG. 10 shows a variation of the first RC circuit depicted in FIG. 8.
Figure 11:
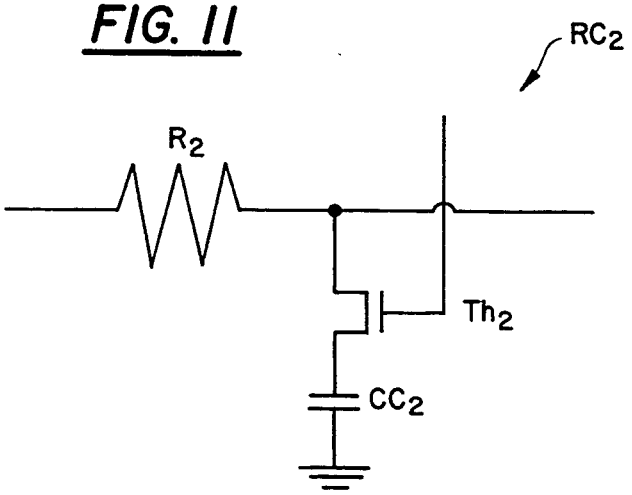
FIG. 11 shows the second RC circuit depicted in FIG. 8.
Figure 12:
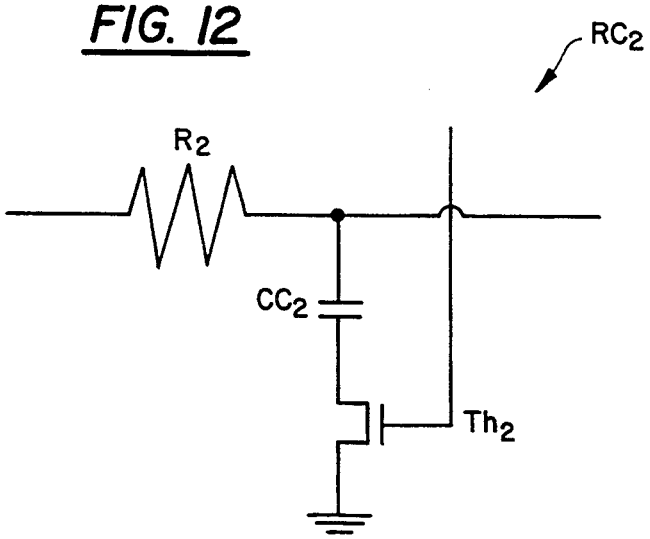
FIG. 12 shows a variation of the second RC circuit depicted in FIG. 8.

$RC_1$ can be constructed as shown in FIG. 9 or in FIG. 10. In the structure shown in FIG. 9, one end of capacitance $CC_1$ is grounded and the other end is the output terminal to which RP is input through resistance $R_1$. Expressing time as "t", $V_1$ can be expressed as follows:

$$V_1 = RP[1 - e^{-\left(\frac{t}{R_1CC_1}\right)}] \quad (18)$$

Thus, $V_1$ increases with time.

The formula of (17) can then be rewritten as:

$$V_2 = \frac{X + RP[1 - e^{-\left(\frac{t}{R_1CC_1}\right)}]}{2} \quad (19)$$

Thus, $V_2$ increases with time. When the structure in FIG. 9 is used, threshold element $Th_1$ produces an output which corresponds to the input over if it is above a threshold voltage.

FIG. 10 shows a structure similar to the structure in FIG. 9 with $R_1$ and $CC_1$ switched. Voltages $V_1$ and $V_2$ can be expressed by the formula:

$$V_1 = RPe^{-\left(\frac{t}{R_1CC_1}\right)} \quad (20)$$

-continued $$V_2 = \frac{X + RPe^{-(\frac{t}{R1CC1})}}{2} \quad (21)$$

Thus, both of these voltages decrease with time.

When the structure in FIG. 10 is used, threshold element $Th_1$ produces a corresponding output when the input is equal to or below a threshold voltage.

$RC_2$ can be any of the structures shown in FIGS. 11–14. All of these comprise threshold element $Th_2$, resistance $R_2$ and capacitance $CC_2$. The circuit structures shown in FIG. 11 and 12 have the characteristic of increasing with time. Threshold element $Th_2$ performs a type of breaking between $R_2$ and $CC_2$ in FIG. 11, and between $CC_2$ and ground in FIG. 12. The output voltage Y of $RC_2$ depicted in FIG. 11 and 12 can be represented by the formula:

$$Y = RP[1 - e^{-(\frac{t}{R2CC2})}] \quad (22)$$

Figure 13:
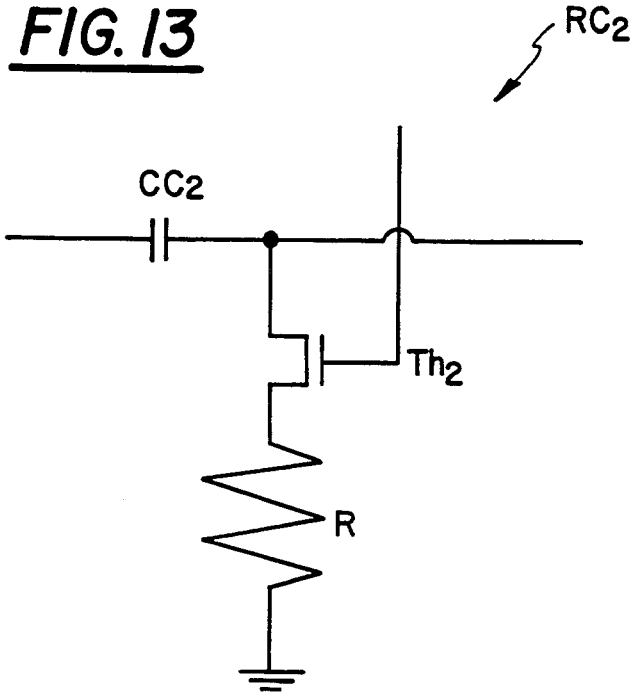
FIG. 13 shows another variation of the second RC circuit depicted in FIG. 8.
Figure 14:
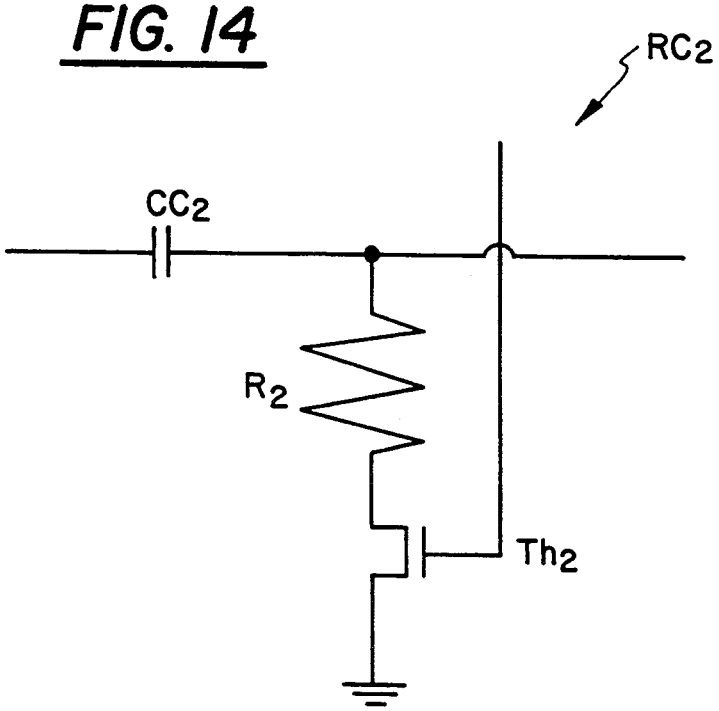
FIG. 14 shows another variation of the second RC circuit depicted in FIG. 8.

The structures in FIG. 13 and 14 have the characteristic of decreasing with time. Threshold element $Th_2$ performs a type of breaking between $R_2$ and $CC_2$ in FIG. 13, and between $CC_2$ and ground in FIG. 14. The characteristic of these circuits can be expressed as:

$$Y = RPe^{-(\frac{t}{R2CC2})} \quad (23)$$

Threshold element $Th_1$ generates an output when $V_2$ is equal to the threshold voltage $V_{th}$, consequently, $Th_2$ performs a type of breaking and the voltage Y is preserved due to the fact that charging of capacitance $CC_2$ has stopped.

Combining formulas {(19) and (22)} or {(21) and (23)} gives the following formula:

$$Y = RP\left[\frac{2\,V_{th} - X}{RP}\right]^{(\frac{R1CC1}{R2CC2})} \quad (24)$$

Combining formulas {(19) and (23)} or {(21) and (22)} gives the following formula:

$$Y = RP\left[\frac{RP + X - 2\,V_{th}}{RP}\right]^{(\frac{R1CC1}{R2CC2})} \quad (25)$$

When RP is equal to $2V_{th}$, formulas (24) and (25) can be simplified to the following formulas:

$$Y = RP\left[-\frac{X}{RP}\right]^{(\frac{R1CC1}{R2CC2})} \quad (26)$$

$$Y = RP\left[\frac{X}{RP}\right]^{(\frac{R1CC1}{R2CC2})} \quad (27)$$

As seen by the formulas above, the calculating circuit in this embodiment of the invention can perform exponential calculation on the input X with the exponent being equal to $(R_1CC_1)/(R_2CC_2)$. The characteristics of the circuit described by formulas (24) and (25) can be obtained from the relationship between $RC_1$ and $RC_2$. Furthermore, the simple characteristics of the circuit described by formulas (26) and (27) can be obtained from the relationship between $V_{th}$ and RP.

Figure 15:
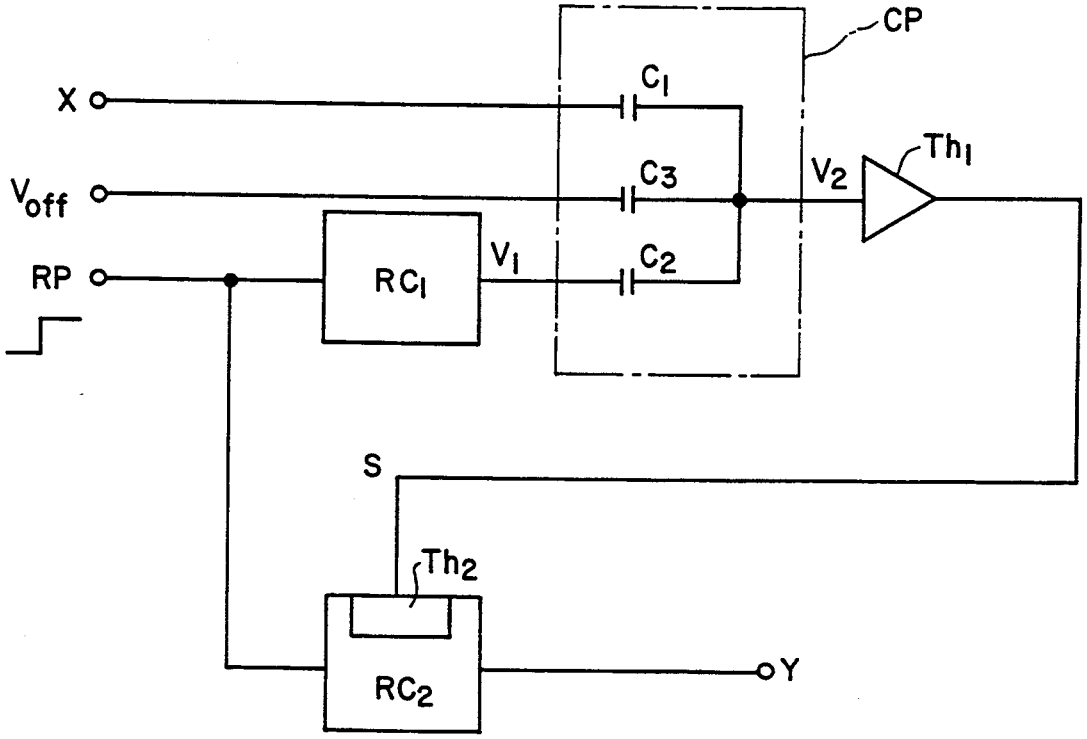
FIG. 15 depicts another embodiment of an exponential circuit according to the present invention.

In FIG. 15, the computation circuit comprises a first and the second RC circuits $RC_1$ and $RC_2$, respectively, to which a standard voltage pulse RP is input. The capacitance of $RC_1$ and $RC_2$ is charged by voltage pulse RP in accordance to its time constant. The output voltage $V_1$ of $RC_1$ is input to one terminal of capacitance coupler CP, input voltage X is input to another terminal of CP, and offset voltage $V_{off}$ is input to a third terminal of CP.

Expressing each capacitance value of CP as $C_1$, $C_2$ and $C_3$, the output voltage $V_2$ of CP can then be expressed by the following formula:

$$V_2 = \frac{C_1X + C_2V_1 + C_3V_{off}}{C_1 + C_2 + C_3} \quad (28)$$

In formula (28), X, $V_1$ and $V_{off}$ are parallel. If $C_1$, $C_2$ and $C_3$ are selected to be equival to each other, the formula (28) can be expressed as:

$$V_2 = \frac{X + V_1 + V_{off}}{3} \quad (29)$$

The output voltage $V_2$ of CP is input to threshold element $Th_1$ which outputs an output voltage "S" when $V_2$ reaches the predetermined threshold voltage $V_{th}$.

Figure 16:
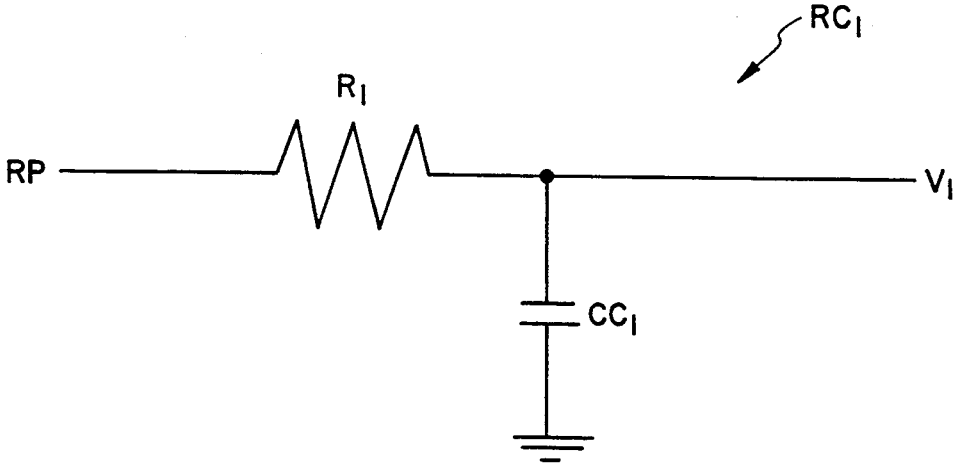
FIG. 16 shows the first RC circuit depicted in FIG. 15.
Figure 17:
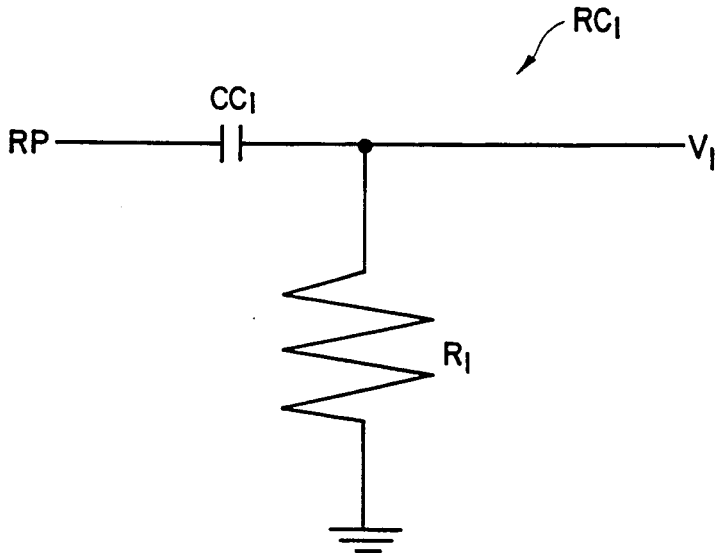
FIG. 17 shows a variation of the first RC circuit depicted in FIG. 15.

$RC_1$ can have the construction as shown in FIG. 16 or in FIG. 17. In the structure in FIG. 16, one terminal of capacitance $CC_1$ is grounded and the other terminal is used as the output terminal to which voltage pulse RP is input through resistance $R_1$. Expressing time as "t", $V_1$ can be expressed by the following formula:

$$V_1 = RP[1 - e^{-(\frac{t}{R1CC1})}] \quad (30)$$

Thus, $V_1$ increases with time. According to formula (30), formula (29) can be rewritten as:

$$V_2 = \frac{X + RP[1 - e^{-(\frac{t}{R1CC1})}] + V_{off}}{3} \quad (31)$$

If the structure in FIG. 16 is used, threshold element $Th_1$ produces an output corresponding to the input when the input is over the threshold voltage.

The circuit in FIG. 17 has the same type of structure used in FIG. 16 with only $CC_1$ and $R_1$ switched. $V_1$ and $V_2$ can be expressed by the formulas:

$$V_1 = RPe^{-(\frac{t}{R1CC1})} \quad (32)$$

$$V_2 = \frac{X + RP\,e^{-(\frac{t}{R1CC1})} + V_{off}}{3} \quad (33)$$

Thus, both of these voltages decrease with time. If the structure in FIG. 17 is used, threshold terminal $Th_1$ produces an output when the input is equal to or below the threshold voltage.

Figure 18:
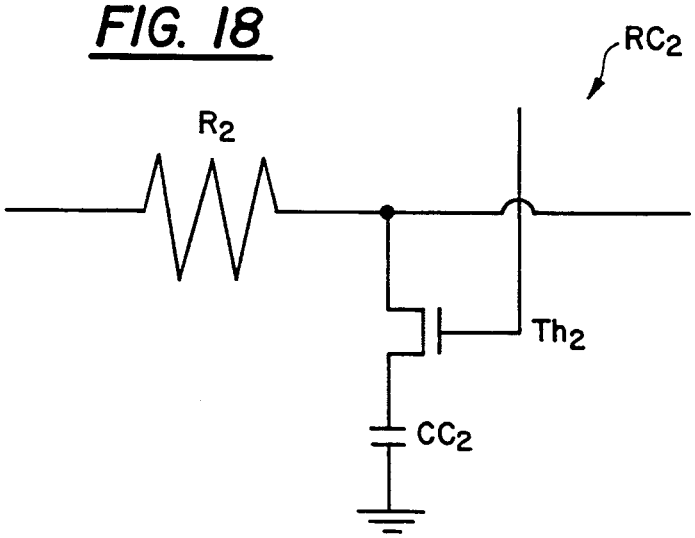
FIG. 18 shows the second RC circuit depicted in FIG.15.
Figure 19:
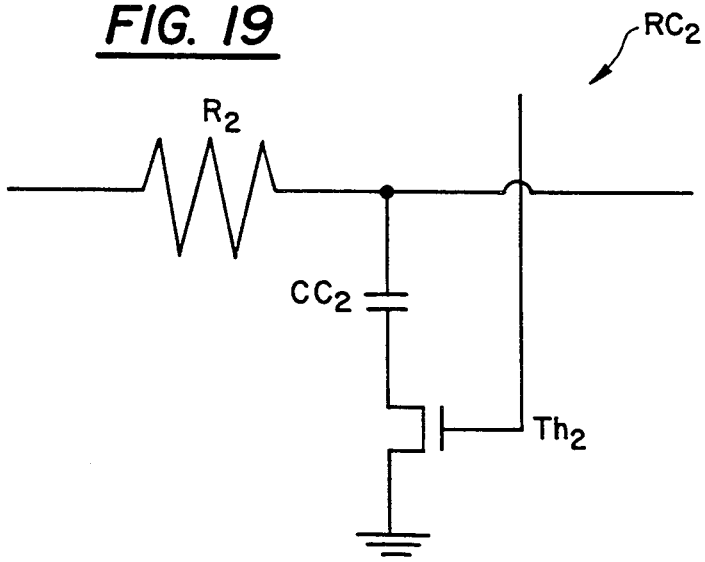
FIG. 19 shows a variation of the second RC circuit depicted in FIG. 15.

$RC_2$ can be one of the structures shown in FIGS. 18–21, all of these embodiments comprise threshold element $Th_2$, resistance $R_2$ and capacitance $CC_2$. The circuit structures shown in FIG. 18 and 19 have the characteristic of increasing with time. Threshold element $Th_2$ in FIG. 18 performs a type of breaking between $R_2$ and $CC_2$. In FIG. 19 on the other hand, threshold element $Th_2$ performs a type of breaking between $CC_2$ and ground. The output voltage Y of $RC_2$ can be represented by the following formula, if the structures shown in FIG. 18 or 19 is used.

$$Y = RP[1 - e^{-(\frac{t}{R2CC2})}] \tag{34}$$

Figure 20:
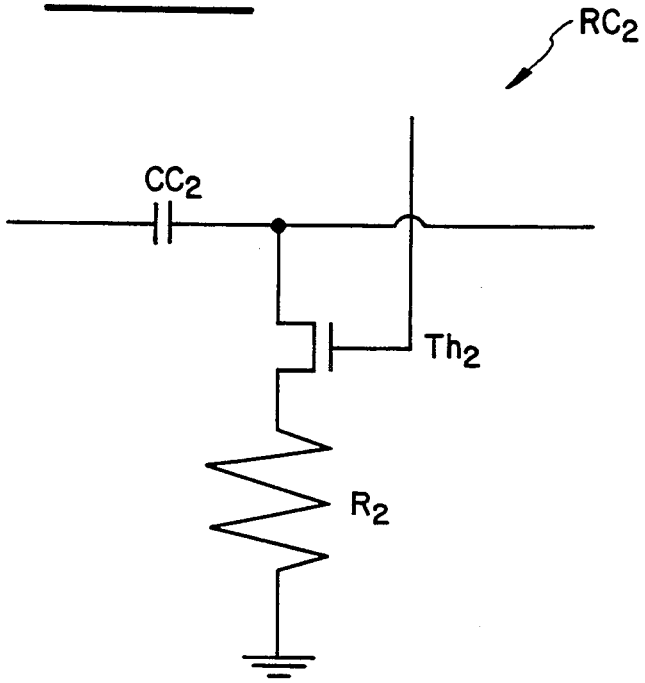
FIG. 20 shows another variation of the second RC circuit depicted in FIG. 15.
Figure 21:
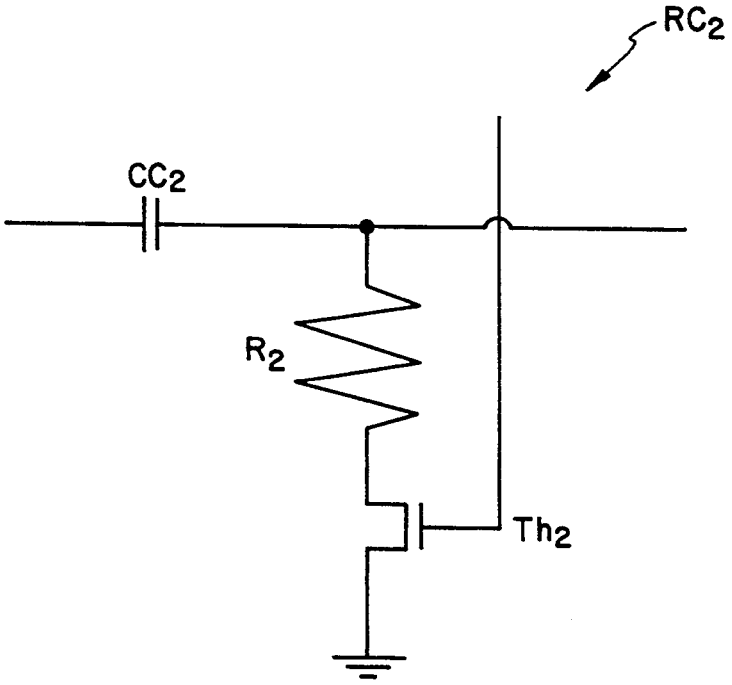
FIG. 21 shows another variation of the second RC circuit depicted in FIG. 15.

The circuit structures shown in FIG. 20 and 21 have the characteristic of decreasing with time. Threshold element $Th_2$ performs a type of breaking between $R_2$ and $CC_2$. In FIG. 21, and on the other hand, $Th_2$ performs a type of breaking between $CC_2$ and ground. The characteristic of these circuits can be expressed as in (35).

$$Y = RPe^{-(\frac{t}{R2CC2})} \tag{35}$$

$Th_1$ generates an output when $V_2$ is equal to the threshold voltage $V_{th}$, consequently, $Th_2$ performs a type of breaking and the voltage Y is preserved because the charging of $CC_2$ has stopped.

Combining formulas {(31) and (34)} or {(33) and (35)}, produces the following formula:

$$Y = RP\left[\frac{3\,V_{th} - X - V_{off}}{RP}\right]^{(\frac{R1CC1}{R2CC2})} \tag{36}$$

Combining formulas {(31) and (35)} or {(33) and (34)}, produces the following formula:

$$Y = RP\left[\frac{RP + X + V_{off} - 3\,V_{th}}{RP}\right]^{(\frac{R1CC1}{R2CC2})} \tag{37}$$

When $(RP+V_{off})$ equals $3V_{th}$, formulas (36) and (37) can be reduced to the following formulas:

$$Y = RP\left[-\frac{X}{RP}\right]^{(\frac{R1CC1}{R2CC2})} \tag{38}$$

$$Y = RP\left[\frac{X}{RP}\right]^{(\frac{R1CC1}{R2CC2})} \tag{39}$$

As seen by the formulas expressed above, the calculating circuit in this embodiment of the invention can perform exponential calculation on the input X with the exponent being $(R_1CC_1)/(R_2CC_2)$. The characteristics of the circuit expressed by formulas (36) and (37) can be obtained from the relationship between $RC_1$ and $RC_2$. Likewise the characteristics of the circuit expressed by formulas (38) and (39) can be obtained from the relationship between $V_{th}$ and Rp. When RP equals $3V_{th}$, the related formula can be simplified without the need for $V_{off}$. On the other hand, $V_{off}$ can be used in order to absorb any deviation in $V_{th}$.

Figure 22:
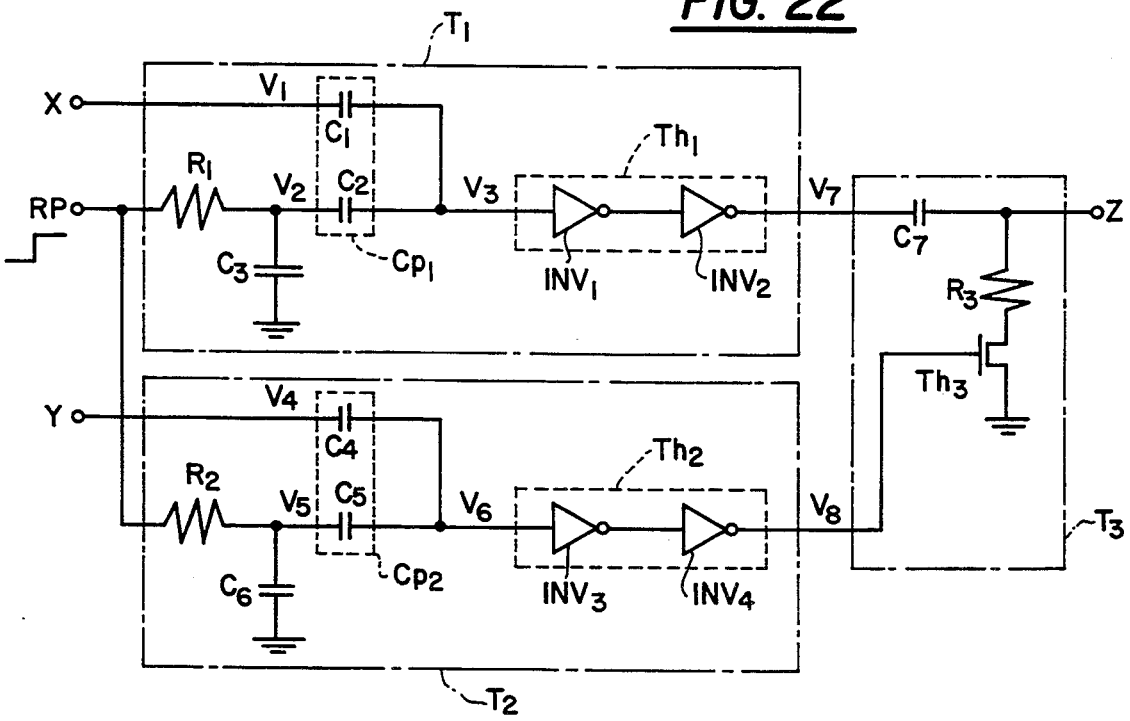
FIG. 22 depicts an embodiment of a subtraction circuit according to the present invention.

As shown in FIG. 22, a multiplication circuit comprises first, second and third times $T_1$, $T_2$ and $T_3$, respectively. Input voltage X is input to timer $T_1$, and input voltage Y is input to timer $T_2$.

Timer $T_1$ comprises threshold element $Th_1$ which generates an output voltage when its input voltage is over the threshold voltage. Capacity coupling $Cp_1$ is connected to the input of threshold element $Th_1$. Capacity coupling $Cp_1$ comprises a pair of capacitances $C_1$ and $C_2$ connected in series. When the voltage input to capacitances $C_1$ and $C_2$ is $V_1$ and $V_2$, respectively, the input voltage $V_3$ for $Th_1$ can be expressed by the following formula:

$$V_3 = \frac{C_1V_1 + C_2V_2}{C_1 + C_2} \tag{40}$$

Threshold element $Th_1$ comprises a pair of inverters connected in series. When $V_3$ exceeds the threshold voltage, the output of $INV_1$ is 0V, and the output of $INV_2$ goes high (i.e. becomes its maximal voltage $V_m$). The first input voltage X is connected to $C_1$. The standard voltage pulse RP is connected to $C_2$ through resistance $R_1$. $C_2$ is grounded through charging capacitance $C_3$. When RP goes high $C_3$ is charged and $V_2$ rises up to the same voltage level as RP.

When RP rises up to a predetermined level and X is input to $C_1$, $C_3$ is charged by a time constant which is determined by the value of $C_3xR_1$. Expressing time as "t", $V_3$ can be expressed by the formula:

$$V_3 = \frac{C_1X + C_2RP[1 - e^{-(\frac{t}{R1C3})}]}{C_1 + C_2} \tag{41}$$

As seen by the expression in (41), $V_3$ rises as time increases. When $V_3$ exceeds the threshold voltage $V_{th1}$ of $Th_1$, the output voltage $V_7$ of $Th_1$ becomes the maximal voltage $V_m$. The period of time it takes $V_3$ to rise from 0V to the threshold voltage $V_{th1}$ is "tx". $V_{th1}$ can then be represented by the formula:

$$V_{th1} = \frac{C_1X + C_2RP[1 - e^{-(\frac{tx}{R1C3})}]}{C_1 + C_2} \tag{42}$$

Timer $T_2$ comprises threshold element $Th_2$, a two input capacity coupling $Cp_2$, charging capacitance $C_6$ and resistance $R_2$. They are connected in a similar manner as its corresponding components in timer $T_1$. Capacity coupling $Cp_2$ comprises a couple of capacitances $C_4$ and $C_5$ connected in series. When the voltage input to $C_4$ and $C_5$ are labeled $V_4$ and $V_5$, respectively, input voltage $V_6$ for $Th_2$ can be expressed by the following formula:

$$V_6 = \frac{C_4V_4 + V_5V_5}{C_4 + C_5} \tag{43}$$

$Th_2$ comprises a pair of inverters connected in series. When $V_6$ exceeds the threshold voltage, the output of $INV_3$ is 0V, and the output of $INV_4$ goes high (i.e. becomes the maximal voltage $V_m$). The second input voltage Y is connected to capacitance $C_4$. The standard voltage pulse RP is connected to capacitance $C_5$ through resistance $R_2$. Capacitance $C_5$ is grounded through charging capacitance $C_6$. When RP goes high, $C_6$ is charged and $V_5$ rises up to the same voltage level as RP.

When RP rises up to the predetermined level and Y is input to capacitance $C_4$, capacitance $C_6$ is charged by a time constant determined by the value of $C_6 x R_2$. Expressing time as "t", $V_6$ can be represented by the following formula:

$$V_6 = \frac{C_4 Y + C_5 RP[1 - e^{-(\frac{t}{R2C6})}]}{C_4 + C_5} \quad (44)$$

As seen by formula (44), $V_6$ rises as time increases. When $V_6$ exceeds the threshold voltage $V_{th2}$ of threshold element $Th_2$, the output voltage $V_8$ of $Th_2$ becomes the maximal voltage $V_m$. The time period it takes $V_6$ to rise from 0V to the threshold voltage $V_{th2}$ is expressed by "ty", $V_{th2}$ can then be represented by the following formula:

$$V_{th2} = \frac{C_4 Y + C_5 RP[1 - e^{-(\frac{ty}{R2C6})}]}{C_4 + C_5} \quad (45)$$

$T_3$ comprises charging capacitances $C_7$. $V_7$ is input to one terminal of $T_3$ and the output voltage Z is measured at the other terminal. The output side of capacitance $C_7$ is grounded through resistance $R_3$, and an nMOS ("$Th_3$", hereafter) $V_8$ is input to the gate of $Th_3$. Capacitance $C_7$ is charged from the point that $V_7$ is $V_m$, and it is completed at the point that $V_8$ is $V_m$ by the breaking of $Th_3$. That is, capacitance $C_7$ is charged during the time period (ty-tx). Therefore, "Z" can be expressed by the following formula:

$$Z = V_m e^{-(\frac{ty-tx}{R3C1})} \quad (46)$$

Formula (42) can now be expressed as:

$$e^{-(\frac{tx}{R1C3})} = \frac{(C_1 + C_2)V_{th1} - C_1 X - C_2 RP}{C_2 RP} \quad (47)$$

Likewise, formula (45) can be expressed as:

$$e^{-(\frac{ty}{R2C5})} = \frac{(C_4 + C_5)V_{th2} - C_4 Y - C_5 RP}{C_5 RP} \quad (48)$$

When the formulas (47) and (48) are used in formula (46), the following formula is derived:

$$Z = V_m \left[ \frac{\left( \frac{(C_4 + C_5)V_{th2} - C_4 Y - C_5 RP}{C_5 RP} \right)}{\left( \frac{(C_1 + C_2)V_{th1} - C_1 Y - C_2 RP}{C_2 RP} \right)} \right] \quad (49)$$

If $V_{th1} = V_{th2} = V_m/2$, $V_m = RP$, and $C_1 = C_2 = C_3 = C_4 = C_5 = C_6$, formula (49) becomes:

$$Z = V_m \left( \frac{Y}{X} \right) \quad (50)$$

Thus, by this embodiment of the invention, division of X and Y can be obtained. This calculation is very precise and it is clear from FIG. 22, the circuit is very simple in structure.

Figure 23:
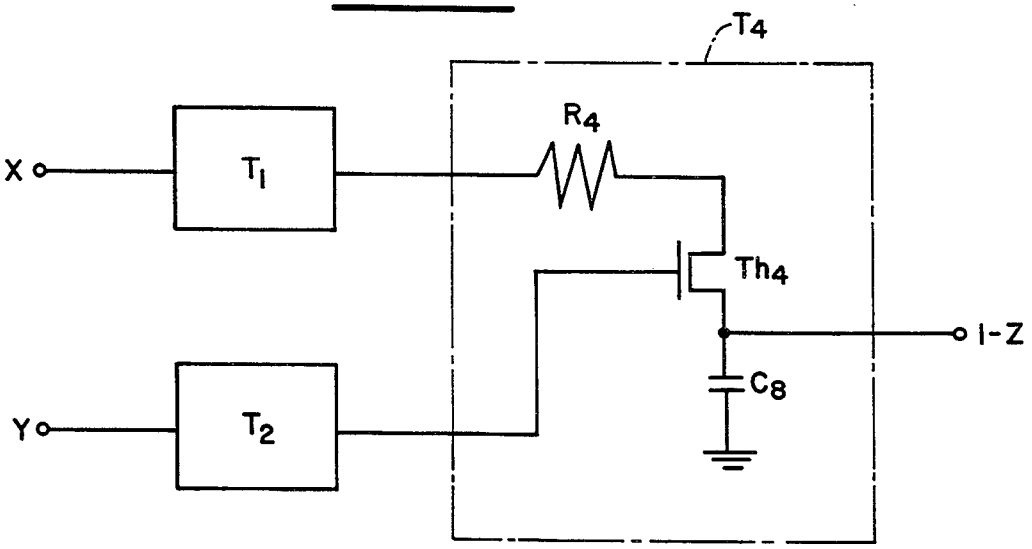
FIG. 23 shows a variation of the third timer depicted in FIG. 22.

FIG. 23 shows a timer $T_4$ comprising a resistance $R_4$, a CMOS $Th_4$ and a capacitance $C_8$ in series instead of timer $T_3$. Timer $T_4$ is connected to timer $T_1$ through resistance $R_4$, $C_8$ is grounded, and timer $T_2$ is connected to the gate of the CMOS $Th_4$. The output terminal of timer $T_4$ is located between $Th_4$ and $C_8$. The output voltage 1-Z of timer $T_4$ is expressed by the following formula:

$$1 - Z = V_m[1 - e^{-(\frac{ty-tx}{R4C8})}] \quad (51)$$

If $R_4 = R_1 = R_2$ and $C_8 = C_3 = C_6$, formula (51) can be reduced to:

$$1 - Z = V_m \quad (52)$$

As seen by formula (52), the calculation of compliment of the quotient is performed by this circuit.

Figure 24:
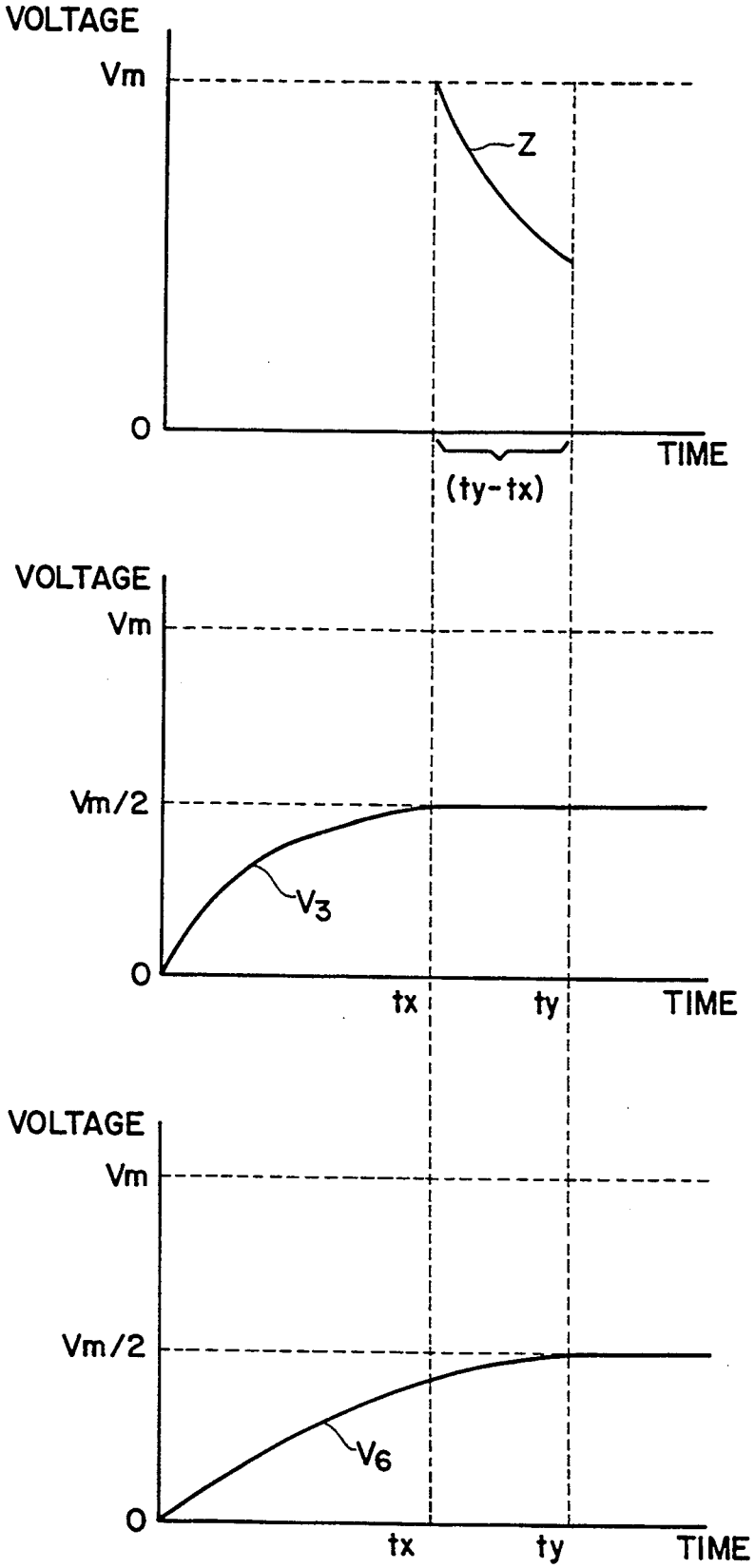
FIG. 24 is a graph showing the relationship between time and the voltage at $V_6$, $V_3$ and Z as seen in FIG. 22.

FIG. 24 is a set of graphs showing the voltages at $V_3$, $V_6$, and Z for the embodiment depicted in FIG. 22.

What is claimed is:

1. A calculating circuit comprising:

a circuit input for receiving a first input voltage;

a circuit output;

a first timer; and a second timer; wherein said first timer comprises:

a first RC circuit for outputting a first RC circuit output voltage which is based upon a second input voltage and changes according to a first exponential function of time;

a first capacitive coupler for outputting a first capacitive coupler output voltage based upon said first input voltage and said first RC circuit output voltage; and first threshold means, having a first threshold input terminal, for outputting a first timer output voltage based on a comparison of said first capacitive coupler output voltage and a first predetermined threshold level;

wherein said first capacitive coupler comprises:

a first capacitive coupler input connected to said circuit input;

a second capacitive coupler input; and a first capacitive coupler output, connected to said first threshold input terminal, for outputting said first capacitive coupler output voltage; and wherein said first RC circuit comprises:

a first resistance;

a first capacitance coupled to said first resistance;

a first RC input, coupled to at least one of said first resistance and said first capacitance, for receiving said second input voltage; and a first RC output, connected to at least one of said first resistance and said first capacitance, and to said second capacitive coupler input, for outputting said first RC circuit output voltage; and wherein said second timer comprises:

second threshold means, connected to said first threshold means, for outputting a second timer output voltage based on a comparison of said first timer output voltage and a second predetermined threshold level; and a second RC circuit for outputting a circuit output voltage which is based upon a third input voltage and said second timer output voltage, and changes according to a second exponential function of time;

wherein said second RC circuit comprises:

a second resistance;

a second capacitance coupled to said second resistance;

a second RC input, coupled to at least one of said second resistance and said second capacitance, for receiving said third input voltage; and a second RC output, connected to at least one of said second resistance and said second capacitance, and to said circuit output, for outputting said circuit output voltage.

2. A calculating circuit according to claim 1 including a third timer comprising:

a third RC circuit for outputting a third RC circuit output voltage which is based upon said third input voltage and changes according to a third exponential function of time;

a second capacitive coupler for outputting a second capacitive coupler output voltage based upon a fourth input voltage and said third RC circuit output voltage; and a third threshold means, having a second threshold input terminal, for producing said second input voltage based upon a comparison of said second capacitive coupler output voltage and a third predetermined threshold level;

wherein said second capacitive coupler comprises:

a third capacitive coupler input for receiving said fourth input voltage;

a fourth capacitive coupler input; and a second capacitive coupler output, connected to said second threshold input terminal, for outputting said second capacitive coupler output voltage; and wherein said third RC circuit comprises:

a third resistance; a third capacitance coupled to said third resistance;

a third RC input, coupled to at least one of said third resistance and said third capacitance, for receiving said third input voltage-;

a third RC output, connected to at least one of said third resistance and said third capacitance, and to said fourth capacitive coupler input, for outputting said third RC circuit output voltage.

3. A calculation circuit according to claim 2 wherein a time constant of said first RC circuit, a time constant of said second RC circuit and a time constant of said third RC circuit are equal.

4. A calculation circuit according to claim 2 wherein said first predetermined threshold level, said second predetermined threshold level, and said third predetermined threshold level are equal.

5. A calculation circuit according to claim 2 wherein said third predetermined threshold level is equal to said first predetermined threshold level; and wherein said first input voltage and said fourth input voltage are equal to one half of said third input voltage.

6. A calculating circuit according to claim 1 including a third timer comprising:

a third RC circuit for outputting a third RC circuit output voltage which is based upon said second input voltage and changes according to a third exponential function of time;

a second capacitive coupler for outputting a second capacitive coupler output voltage based upon a fourth input voltage and said third RC circuit output voltage; and a third threshold means, having a second threshold input terminal, for producing said third input voltage based upon a comparison of said second capacitive coupler output voltage and a third predetermined threshold level;

wherein said second capacitive coupler comprises:

a third capacitive coupler input for receiving said fourth input voltage;

a fourth capacitive coupler input; and a second capacitive coupler output, connected to said second threshold input terminal, for outputting said second capacitive coupler output voltage; and wherein said third RC circuit comprises:

a third resistance;

a third capacitance coupled to said third resistance;

a third RC input, coupled to at least one of said third resistance and said third capacitance, for receiving said second input voltage;

a third RC output, connected to at least one of said third resistance and said third capacitance, and to said fourth capacitive coupler input, for outputting said third RC circuit output voltage.

7. A calculation circuit according to claim 6 wherein a time constant of said first RC circuit, a time constant of said second RC circuit and a time constant of said third RC circuit are equal.

8. A calculation circuit according to claim 6 wherein said first predetermined threshold level, said second predetermined threshold level, and said third predetermined threshold level are equal.

9. A calculation circuit according to claim 6 wherein said first predetermined threshold level, said second predetermined threshold level, and said third predetermined threshold level are equal; and wherein said first predetermined threshold level is equal to one half of said first timer output voltage; and wherein said first timer output voltage is equal to said second input voltage.

10. A calculating circuit according to claim 6 wherein said third predetermined threshold level is equal to said first predetermined threshold level; and wherein said first input voltage and said fourth input voltage are equal to one half of said second input voltage.

11. A calculating circuit according to claim 1 wherein a time constant of said first RC circuit is equal to a time constant of said second RC circuit.

12. A calculating circuit according to claim 1 wherein a time constant of said first RC circuit is equal to a time constant of said second RC circuit multiplied by a real positive number larger than 1.

13. A calculating circuit according to claim 1 wherein a time constant of said second RC circuit is equal to a time constant of said first RC circuit multiplied by a real positive number larger than 1.

14. A calculating circuit according to claim 1 Wherein a time constant of said first RC circuit is equal to a time constant of said second RC circuit multiplied by a real positive integer larger than 1.

15. A calculating circuit according to claim 1 wherein a time constant of said second RC circuit is equal to a time constant of said first RC circuit multiplied by a real positive integer larger than 1.

16. A calculating circuit according to claim 1 wherein said first resistance comprises:

a first resistance terminal connected to said second input voltage; and a second resistance terminal connected to said second capacitive coupler input; and wherein said first capacitance comprises:

a first capacitance terminal connected to said second resistance terminal; and a second capacitance terminal which is grounded.

17. A calculating circuit according to claim 1 wherein said second resistance comprises:

a first resistance terminal connected to said third input voltage; and a second resistance terminal; and wherein said second capacitance comprises:

a first capacitance terminal connected to said second resistance terminal; and a second capacitance terminal for receiving said second timer output voltage.

18. A calculating circuit according to claim 1 wherein said first capacitance comprises:

a first capacitance terminal connected to said second input voltage; and a second capacitance terminal connected to said second capacitive coupler input; and wherein said first resistance comprises:

a first resistance terminal connected to said second capacitance terminal; and a second resistance terminal which is grounded.

19. A calculating circuit according to claim 1 wherein said second capacitance comprises:

a first capacitance terminal connected to said third input voltage; and a second capacitance terminal; and wherein said second resistance comprises:

a first resistance terminal connected to said second capacitance terminal; and a second resistance terminal for receiving said second timer output voltage.

20. A calculating circuit according to claim 1 wherein said first predetermined threshold level and said second predetermined threshold level are equal.

21. A calculating circuit according to claim 1 wherein said first predetermined threshold level and said second predetermined threshold level are equal to one half of said first timer output voltage.

22. A calculation circuit according to claim 2 wherein said first predetermined threshold level, said second predetermined threshold level, and said third predetermined threshold level are equal; and wherein said first predetermined threshold level is equal to one half of said first timer output voltage; and wherein said first timer output voltage is equal to said second input voltage.

23. A calculating circuit according to claim 1 wherein said second input voltage and said third input voltage are equal to one half said first timer output voltage.

24. A calculating circuit according to claim 1 wherein said second threshold means further comprises a field-effect transistor, having a drain and a source; and wherein second resistance comprises:

a first resistance terminal connected to said third input voltage; and a second resistance terminal connected to said drain; and wherein said second capacitance comprises:

a first capacitance terminal connected to said source; and a second capacitance terminal which is grounded.

25. A calculating circuit according to claim 1 wherein said second threshold means further comprises a field-effect transistor, having a drain and a source; and wherein said second capacitance comprises:

a first capacitance terminal connected to said third input voltage; and a second capacitance terminal connected to said drain; and wherein said second resistance comprises:

a first resistance terminal connected to said source; and a second resistance terminal which is grounded.

26. A calculating circuit according to claim 1 wherein said first capacitive coupler further comprises a third capacitive coupler input for receiving an offset voltage.

* * * * *